US005452661A

United States Patent [19]

Neff

[11] Patent Number: 5,452,661

[45] Date of Patent: Sep. 26, 1995

[54] HERMETICALLY SEALED DEVICES FOR LEAK DETECTION

[76] Inventor: George R. Neff, 932 Grand Central Ave., Glendale, Calif. 91201

[21] Appl. No.: 260,071

[22] Filed: Jun. 15, 1994

Related U.S. Application Data

[63] Continuation of Ser. No. 898,715, Jun. 15, 1992, abandoned.

[51] Int. Cl.[6] ..... F42C 19/12

[52] U.S. Cl. ..... 102/202.7; 102/202.14

[58] Field of Search ..... 102/20 2.5, 202.6, 102/202.7, 202.8, 202.9, 202.11, 202.12, 202.13, 202.14

[56] References Cited

U.S. PATENT DOCUMENTS

| | | | |
|---|---|---|---|
| 1,999,820 | 4/1935 | Nash | 102/202.13 |
| 2,133,119 | 10/1938 | Smith et al. | 102/202.13 |
| 2,363,863 | 11/1944 | Hanley | 102/202.13 |
| 3,580,171 | 5/1971 | Maes | 102/202.11 |
| 3,695,179 | 10/1972 | Rainone et al. | 102/202.11 |
| 3,715,983 | 2/1973 | Rosinski | 102/301 |
| 3,910,188 | 10/1975 | Stevens | 102/202.11 |
| 4,746,338 | 5/1988 | Williams | 55/275 |

FOREIGN PATENT DOCUMENTS

| | | | |
|---|---|---|---|
| 583319 | 9/1959 | Canada | 102/202.11 |
| 1179492 | 10/1964 | Germany | 102/202.11 |
| 10837 | of 1904 | United Kingdom | 102/202.5 |

*Primary Examiner*—Stephen M. Johnson

*Attorney, Agent, or Firm*—Harris, Wallen, MacDermott & Tinsley

[57] ABSTRACT

A method of providing a gas-gettering medium within hermetically sealed devices which allows small cavity devices to be leak tested to verify their seal integrity. The gettering medium utilizes forms of charcoal, including activated carbon materials. A hermetically sealed device with the charcoal incorporated therein, as in an otherwise normal void in the device, or mixed with a charge of explosive in the device.

3 Claims, 1 Drawing Sheet

HERMETICALLY SEALED DEVICES FOR LEAK DETECTION

This application is a continuation of application Ser. No. 07/898,715, Jun. 15, 1992, now abandoned.

BACKGROUND OF THE INVENTION (1) Field of the Invention

The invention relates to the field of leak detection enhancement of small cavity devices which depend on hermetic seal integrity.

(2) Description of prior Art

There are many materials used in manufacturing today which are deleteriously affected by common environmental ingredients. Some of the manufactured devices are able to survive in the presence of the moisture or oxygen in our air, while others are degraded, impaired, or caused to fail in the performance of their design objective. Items which fall into this category requiring that they be sealed from the atmosphere, are called "Hermetic Devices". Common examples of these are: light bulbs, television tubes, electronic devices (such as integrated circuit chips, microelectronics, semiconductors), firing mechanisms used in military applications, and most explosives used in safety device applications such as aircraft emergency release systems, automotive air bag deployment, and the like. Materials used in these devices are considered to be "Chemically Incompatible" with our normal atmosphere.

Applications of technology which require manufactured devices to be hermetic (i.e., sealed from atmospheric contaminants such as water vapor, oxygen, organic vapors, and the like), impose an additional need for proof that the devices are in fact sealed. Such verification of hermeticity is usually accomplished through leak testing. There are three basic methods of leak testing which are commonly used in industry.

The first of the methods requires immersion of the device in a very hot liquid for bubble testing. If the device has a leak, the hot liquid will cause gases within the device to expand, leak out of the device, and be seen as bubbles coming out of the actual hole, or leak, in the part. It is designed for the detection of large leaks in the package or device. Such leaks are in some cases visible to the naked eye, and would allow very large amounts of contaminate to leak into a device in a few hours, and thus damage it. This method has achieved limited success because: (1) many devices are never allowed to be submerged in hot liquids, due to possible chemical incompatability, or, in the case of explosives, the dangers of their instability at elevated temperatures; (2) in many cases the devices could not be reworked or repaired after having been immersed in a liquid; and (3) bubble testing is of little value to devices which have no internal free void or cavity which would normally provide gas for leaking out of the device as bubbles.

The second method uses helium gas. One common form of this method consists of subjecting a hermetic device to a pressure of helium gas for some period of time to allow helium to leak into the device (if the device has a leak), and then placing the device in a gas analyzer system and measuring the gas which is sucked back out of the device, if gas has previously entered through the leak.

Many difficulties are encountered with this method and its success for small cavity devices is limited because: (1) the helium gas concentration in the part must be known, for accurate results; (2) there must either be a large enough void or free volume in the part to hold the helium which leaked into it, or there must be some medium within the part which will absorb and hold the helium gas, and then release it when the part is being subjected to gas analysis. With no internal void or absorption medium, this method is quite ineffective. One common variation in the application of the tracer gas leak detection method involves the sealing of a tracer gas within the cavity of the device at the time the device is manufactured. If the percentage of tracer gas is known, and the device is tested for leaks immediately after the manufacturing steps are completed, there is some degree of confidence that a leaking device could be detected. As internal cavity sizes get smaller, the confidence that a leaking device could retain sufficient tracer gas for detection is lost. Additionally, with nothing internally retaining the tracer gas, the loss of the tracer gas is known to be rapid. An even more serious problem exists when a user of such a device makes an assumption that there could still be tracer gas within the device for conventional leak testing at some later date.

The third method uses a radioactive gas, such as Krypton-85, for pressurization of the device. If the device leaks, some of the radioactive gas will enter the device. As in the helium method, this method also has limited success for small cavity devices because: (1) there must either be a free void to hold the gas, or an absorption medium must be used to hold the tracer gas for detection. In the radioactive gas case, the radiation from the tracer gas leaking into the device is detected or measured in place within the device, and is not required to be drawn back out of the device for detection, as in the helium test, thus allowing very small quantities or radioactive tracer to be detected. As with the helium method, if there is no internal void or absorption medium, this method is also unreliable.

SUMMARY OF THE INVENTION

Various techniques have been tried to provide a method of leak testing which can guarantee that a device is hermetic or sealed when manufactured. Materials such as highly absorbent rubber, plastics, partially cured resins, molecular seive materials, sintered materials, and others have been tried as absorption media in hermetics. In some applications these would allow devices with an extremely small internal void to be leak tested. However, in every case, there is still the concern that these materials could impair the proper function and performance of the device. Most of these additives release some chemical constituents with time, thus offering a possible deterioration of the device itself. Most electronic devices, such as integrated circuits, as well as many explosives, are so chemically sensitive, that manufacturers will not allow a material to be enclosed within the cavity which is not metal, ceramic, glass etc. Any additive which has a significant mass-to-volume ratio could also be a mechanical threat, should it vibrate loose within the cavity of the device.

Adding small amount of charcoal to the inside of a sealed device provides a very effective gas gettering and gas retention material, thus allowing detection of the tracer gas for significant periods of time after the device has been pressurized for the leak test. Charcoal, including activated carbon, is an amorphous form of carbon characterized by its high adsorptivity for many gases and vapors. It is obtained by the destructive distillation of wood and other carbonaceous materials. It is activated by heating to 800°–900° C. with steam, which results in a honey-comb structure with very high porosity. The internal surface area of activated carbon averages about 10,000 square feet per gram of material. Charcoal has a very high adsorptivity for the standard tracer gases, and it will not release any harmful chemical vapors into the internal cavity of the device. The material will in fact getter the moisture and other undesirable vapors from the gas phase of the internal cavity of the device, thus helping maintain a clean internal environment.

It is an object of this invention to provide a hermetically sealed device and a method of manufacturing such a device, including electronic devices, electro-mechanical devices, ordnance and/or explosive devices, or any similar object which has a small internal cavity, where a quantity of charcoal is incorporated internally to getter, collect, and assist in retention of a tracer medium, which then permits the device to be tested for leakage by conventional leak testing means.

Another object of the present invention is to provide a method for leak testing such hermetic devices having a small quantity of charcoal mixed with the materials already used in the manufacture of such a device, thus providing a means of gettering and retaining the tracer gas needed for the leak testing of the device.

Still another object of the present invention is to provide a method of storing a leak detection tracer gas within the device at the time the device is manufactured, for retention of the tracer gas for an interval of time necessary for the device to proceed from manufacture to the point in time where it will be leak tested to assure it is hermetically sealed.

It is a further object of this invention to provide a method of gettering and holding some of the unwanted gases which may exist within the device's internal cavity, which gases could be deleterious to the active portions or materials of the device. Examples of unwanted gases include moisture, solvents, oxygen, oxidizers, corrosive chemicals and the like which can attack and degrade the device and thus inhibit its long term objective of design and application. Present manufacturing methods involve extremely costly techniques to hopefully guarantee that the internal cavities of devices are free of all undesirable vapors, and that the materials of construction are free of any vapors which could, with time, bleed out into the internal cavities and degrade the active portions of the device. Small quantities of charcoal placed within the cavity of a device will collect and retain many of the vapors commonly termed as unwanted or undesirable.

DESCRIPTION OF THE PREFERRED EMBODIMENTS

Many types of explosives are manufactured with the powder materials compressed into the explosive container with pressure in the order of 5,000 to 10,000 pounds per square inch. Such compression causes the explosive material to have no interstitial cavities or voids which would otherwise collect and hold gases, such as are required for leak testing the device. The tracer gases which are used in leak testing are dependent upon such cavities to store the gas, or upon the solubility of the gas in the explosive material itself. With such high compression of the materials, there is rarely any solubility in the explosive powders. Zirconium potassium perchlorate, boron potassium nitrate, and lead azide are typical explosive materials used in squibs, detonators, initiators, firing mechanisms, gas generators, etc. These materials are tightly packed to allow reliable propagation of the burning from initiator to the explosive mixture. The initiator uses one of these materials in contact with a resistance or bridge wire, which will cause burning when electric power is applied to the wire. Most of these materials deteriorate when exposed to moisture, thus requiring them to be hermetically sealed. The sealing process usually involves soldering or welding the members of the container together.

Figure 1:
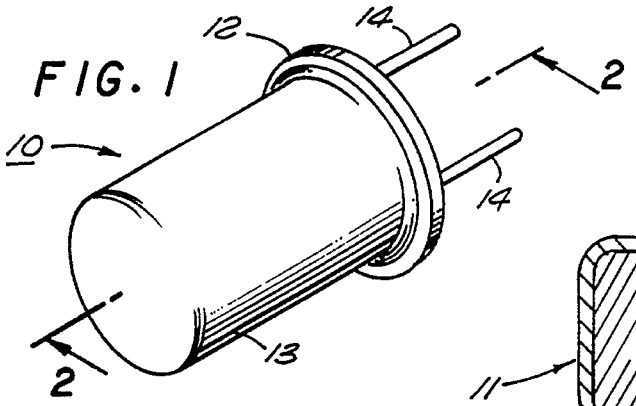
FIG. 1 is a perspective of a hermetically sealed device, such as an explosive squib, incorporating the present preferred embodiment of the invention.
Figure 2:
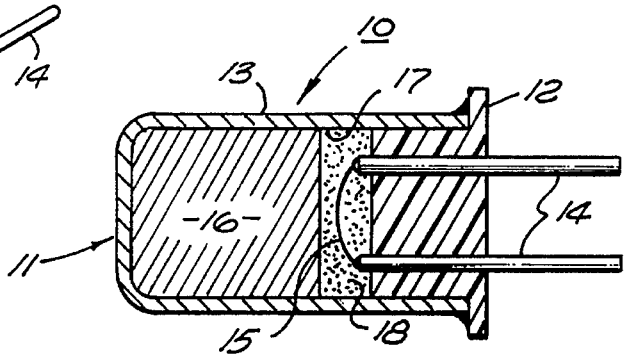
FIG. 2 is a sectional view taken along the line 2—2 of FIG. 1.
Figure 3:
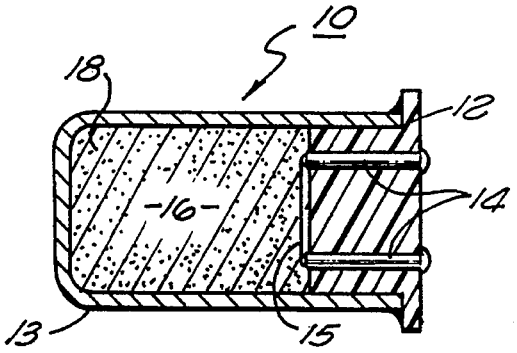
FIG. 3 is a sectional view of an alternative embodiment of the explosive squib.

A typical explosive squib incorporating the presently preferred embodiment of the invention is shown in FIGS. 1 and 2. The squib 10 includes a container 11 formed of members 12, 13. The member 12, sometimes called a base, includes an electrical insulator with conductors 14 carried therein. An initiator wire 15 is positioned across the inner ends of the conductors 14. The member 13, sometimes called a can, is typically of metal with a charge 16 of explosive therein. In the embodiment illustrated in FIGS. 1 and 2, there normally is a void 17 in the area around the initiator wire 15 between the explosive charge 16 and the base member 12. The conductors 14 may project as leads, as shown in FIGS. 1 and 2, or may terminate in terminals, as shown in FIG. 3.

In the squib of the invention, charcoal 18 is positioned in the void 17, typically substantially filling the void, prior to placing the can member 13 over the base member 12. Then the can is sealed to the base in the conventional manner and the squib is ready for testing.

In squibs of this design, typically the void 17 varies in volume from about 0.0001 cc to about 1 cc. Typically with devices with less than 0.1 cc void, conventional leak detection is difficult due to the rapid escape of the very small quantity of tracer gas which can penetrate the container when under pressure. The devices with very small voids or substantially no void at all are known as "Zero Cavity" devices, and one such device is shown in FIG. 3, where components corresponding to those of FIGS. 1 and 2 are identified by the same reference numerals. In this type of squib, the charge of explosive is pressed tightly against the intiator wire and the surface of the insulator base member.

The void in such a device is the interference fit spacing between the can and the insulator. Such a small cavity will not hold enough tracer gas to allow a reliable leak test. In this embodiment the charcoal 18 is added to the explosive charge 16. Quantities up to several percent may be added to typical explosive powders, and will provide adequate absorption of tracer gases such as helium or krypton-85 gas, to assure a valid leak test. While a single explosive charge is shown in FIG. 3, two or more charges may be used, with the charcoal mixed with only one of the charges or with both charges.

The charcoal material used in these applications is preferably not crushed or powdered before it is added to the explosive powder. One half to two percent by weight of a 30–50 mesh charcoal material will blend well with the powder. The mixture may be applied or compressed into the device cavities at significant pressures without elimination of its absorption characteristics. Charcoal prepared from coconut shells and "pineapple charcoal" provide good absorption for the noble gases commonly used as tracer gases in the leak detection process.

Other devices such as electronic devices, typically integrated circuit chips, semiconductors, transistors, microswitches, and the like are fabricated from metal-ceramic-glass, and other totally inert materials. The containers for most of these devices have extremely small cavities, which have made reliable leak detection nearly impossible. One milligram of charcoal will provide as much as several square feet of surface area for absorption and retention of tracer gas, which makes reliable leak detection possible. The charcoal may be packed into the cavity, or bonded to a component or container member using a suitable bonding agent. Since charcoal will withstand extremely high temperatures without damage, it is possible to bond the charcoal to the glass sealing material during the final step when the sealing material is fired.

Figure 4:
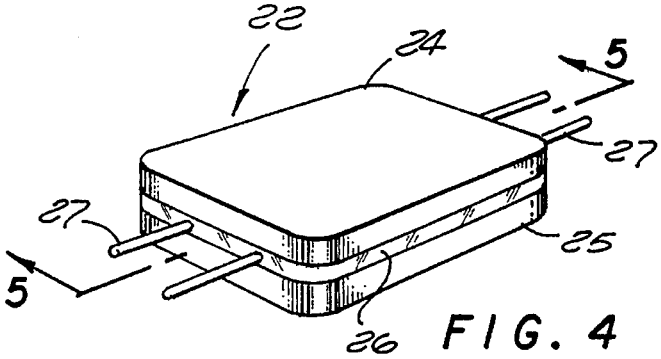
FIG. 4 is a perspective view of alternative embodiment of the invention illustrating a hermetically sealed device with an integrated circuit chip therein.
Figure 5:
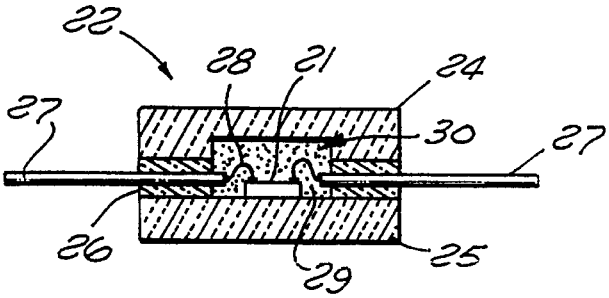
FIG. 5 is a sectional view taken along the line 5—5 of FIG. 4.

By way of example, FIGS. 4 and 5 show an integrated circuit chip 21 in a sealed container 22 with charcoal incorporated within the container. The container has an upper portion 24 joined to a lower portion 25 by glass seal 26, with leads 27 connected at their inner ends to the chip 21 and projecting outward from the container. The circuit chip is mounted on the lower member of the container and is connected to the leads by conventional means, such as by wire connections 28. In the embodiment illustrated, a quantity of charcoal 29 is bonded on the lower container member 25. Also, charcoal may be placed in the void 30 within the container, separately or along with bonded-in-place charcoal.

Figure 6:
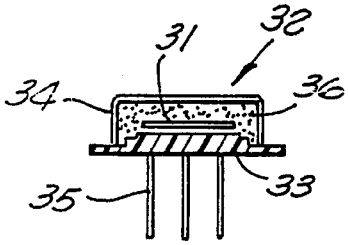
FIG. 6 is a sectional view similar to that of FIG. 5 illustrating another alternative embodiment with a transistor within the hermetically sealed device.

Another alternative embodiment is illustrated in FIG. 6 with a semiconductor, such as a transistor 31 mounted in a container 32 having a base member 33 and a can member 34. The base member normally is an insulator with leads 35 for connection to the transistor 31, which may be a single transistor or a circuit chip with a plurality of transistors and other components. Prior to sealing the can member to the base member, a quantity of charcoal 36 is placed in the can member. Alternatively, the charcoal can be positioned around the transistor and the base member.

It will be readily understood that the same construction as described in the preceeding embodiments can be utilized for any component which needs to be hermetically sealed in a container.

After the components and the charcoal have been sealed in the container, the device is tested for leaks in the manner described above. In one method, the device is exposed to a fluid under pressure which can penetrate the container through any existing leak. Assuming that there is a leak, after the external pressure is removed, the leaked fluid now under pressure within the container will escape through the leak. The presence of such leaked fluid around the container is identified using conventional equipment. In an alternative method, the container is subjected to a radioactive fluid under pressure. After the external radioactive material is removed, the device is tested for presence of radioactive material within the container which would indicate that radioactive fluid has leaked into the container.

In the device and method of the invention, the presence of the charcoal within the container will prevent the tracer fluid which has leaked into the container from escaping too rapidly from within the container so as to make detection difficult. In the arrangement where the charcoal is mixed with active material within the device, typically a charge of explosive, a larger and more even distribution of the tracer medium is achieved, thereby providing a slower and more controlled release of the tracer medium during the subsequent analysis for presence of the tracer medium.

The invention provides for utilizing the charcoal even in zero cavity or void free devices by permitting the charcoal to be mixed with one or more components of the device.

Another advantage of the invention is that the gettering characteristic of the charcoal provides for removal of otherwise unwanted or undesirable gases within the device, thus reducing the likelihood of damage or degradation to the performance of the device which might result from the presence of such undesirable gases. When used with explosive squibs and the like, performance of the explosive can be enhanced through the added distribution of interstitial oxygen collected by gettering and thereby concentrated within the explosive powder.

I claim:

1. A device having a container including at least two members, all said members being hermetically sealed together so that when properly assembled the hermetically sealed container will not pass a test tracer gas from the exterior of the container to the interior of the container, a quantity of coconut shell charcoal incorporated within said container before said sealing, said coconut shell charcoal being capable of gettering and retaining said test tracer gas leaking into said container during testing under external gas pressure for leakage of said hermetic seal prior to use of the device, and a charge of explosive, an igniter wire for said charge, and electrical conductors for connecting said igniter wire to an external power source, said charge, igniter wire and conductors being within said hermetically sealed container, and with said quantity of coconut shell charcoal disposed about said igniter wire, for leakage testing prior to igniting said explosive charge.

2. A device as defined in claim 1 with said container members providing a charcoal zone within said container, and with said quantity of charcoal disposed in said charcoal zone.

3. A device having a container including at least two members, all said members being hermetically sealed together so that when properly assembled the hermetically sealed container will not pass a test tracer gas from the exterior of the container to the interior of the container, and a quantity of coconut shell charcoal, a charge of explosive, an igniter wire for said charge, and electrical conductors for connecting said igniter wire to an external power source, said charcoal, charge, igniter wire and conductors being incorporated within said container before said sealing, with said quantity of coconut shell charcoal disposed about said igniter wire said coconut shell charcoal being capable of gettering and retaining said test tracer gas which could leak into said container during testing for said hermetic seal of said container by subjection to external tracer gas pressure prior to igniting said explosive charge.

* * * * *